United States Patent [19]

Moore

[11] 4,228,744

[45] Oct. 21, 1980

[54] PALLET FORMED FROM TWO SPACED, INTERLOCKING SHEETS OF CORRUGATED PAPERBOARD AND RIGID SLEEVES

[75] Inventor: Robert L. Moore, Nagog Woods, Mass.

[73] Assignee: Champion International Corporation, Stamford, Conn.

[21] Appl. No.: 42,138

[22] Filed: May 24, 1979

[51] Int. Cl.[2] ..... B65D 19/34

[52] U.S. Cl. ..... 108/51.3; 108/56.1; 108/57.1

[58] Field of Search ..... 108/51.3, 56.1, 56.3, 108/55.5, 57.1; 206/597, 599, 600, 386

[56] References Cited

U.S. PATENT DOCUMENTS

| | | | |
|---|---|---|---|
| 2,507,588 | 5/1950 | Brandon et al. | 108/55.5 X |
| 2,888,221 | 5/1959 | Connelly | 108/51.3 |
| 2,970,797 | 2/1961 | Desbois | 108/51.3 |
| 3,520,258 | 7/1970 | Shepherd | 108/51.3 |
| 3,683,823 | 8/1972 | Schmid | 108/56.1 |

FOREIGN PATENT DOCUMENTS

| | | | |
|---|---|---|---|
| 642158 | 6/1962 | Canada | 108/51.3 |
| 2247392 | 5/1975 | France | 206/599 |
| 934005 | 8/1963 | United Kingdom | 108/57.1 |
| 1163135 | 9/1969 | United Kingdom | 108/51.3 |

*Primary Examiner*—William E. Lyddane

*Attorney, Agent, or Firm*—Evelyn M. Sommer

[57] ABSTRACT

Disclosed is a pallet constructed of paperboard material which is preferably water resistant. Two sheets of corrugated paperboard which are cut to define interlocking tabs are spaced in parallel relationship by a plurality of cylindrical sleeves, or rectangular corrguated tubes. The tabs are bent perpendicular to the sheets. Slots in tabs in one sheet interlock with slots in opposed tabs in the other sheet. The cylindrical sleeves or rectangular tubes surround the tabs to thereby provide lateral stability as well as vertical strength. Preferably, the corrugated paperboard sheets are impregnated with a waterproofing material such as wax, and the cylindrical sleeves are constructed of spirally-wound paperboard, or, alternatively are in the form of corrugated tubes.

14 Claims, 8 Drawing Figures

Fig. 1.
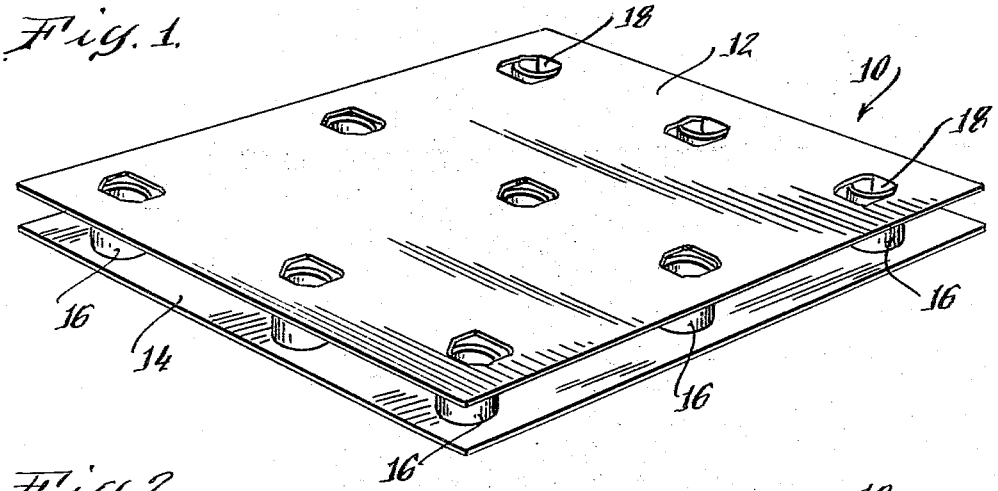
Fig. 2.
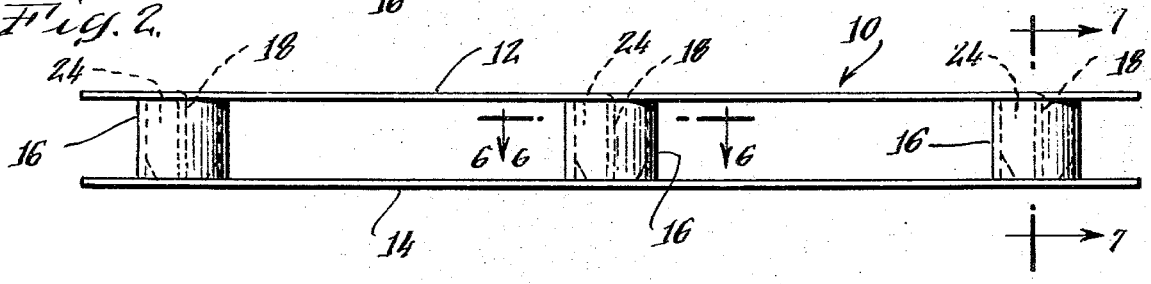
Fig. 5.
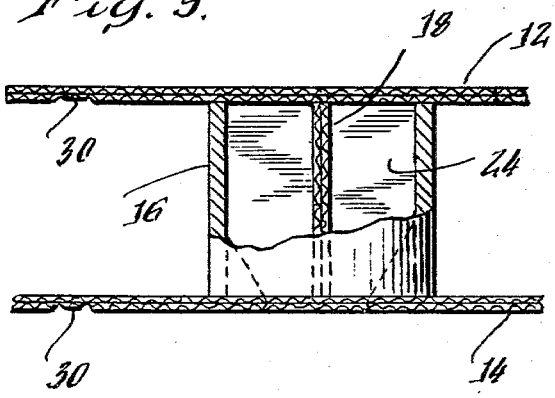
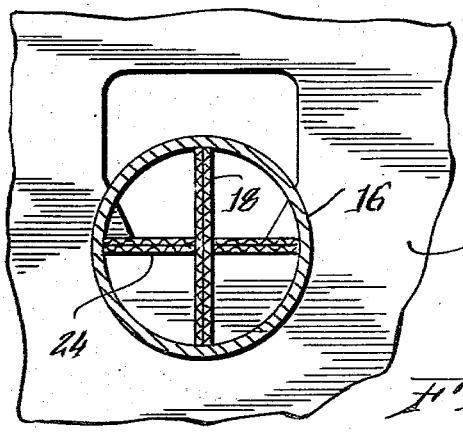
Fig. 6.
Fig. 7.
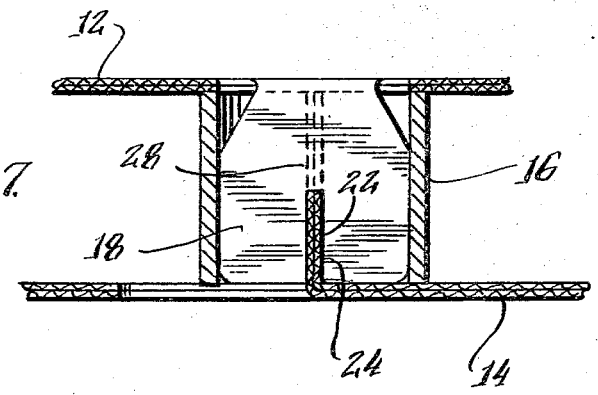
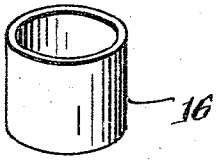
Fig. 8.

PALLET FORMED FROM TWO SPACED, INTERLOCKING SHEETS OF CORRUGATED PAPERBOARD AND RIGID SLEEVES

BACKGROUND OF THE INVENTION

The present invention relates to pallets of the type used to store and transport manufactured goods and more particularly, to pallets of this type constructed of paper materials.

Pallets have been widely used for stacking manufactured goods during storage in a manner which permits easy movement. In the past, the majority of pallets have been constructed of softwood. Of the available materials, softwood has provided the best balance of strength and cost. However, the cost of making and repairing wooden pallets is rising at a rate that is detracting from the cost effectiveness of palletized shipment. Moreover, empty wooden pallets require substantial space for storage, and transportation of empty pallets by rail or truck is especially costly.

There have been a variety of attempts over the years to replace wooden pallets with those constructed of paperboard. However, they were not as sturdy as wooden pallets and none has received widespread acceptance. In recent years attempts have been made to replace the bulky and expensive wooden pallets with paperboard sheets called slip sheets. These slip sheets simply comprise a sheet of corrugated paperboard which is slightly larger than the dimension of the goods to be stacked thereon. The slip sheet is neither intended for nor capable of supporting the weight of the stacked goods, and must always be supported on a suitable horizontal surface. By providing an extra marginal edge of corrugated board material, it is possible to grasp and slide the sheets and the goods carried thereon about the floor or onto a specially designed lift truck.

While slip sheets have provided considerable cost savings in many industrial situations, they are not suitable to fully replace palletized shipments in many others. For example, difficulties have been encountered where heavily loaded slip sheets are positioned directly adjacent the doorway of a fully loaded boxcar or truck trailer. When so positioned, the lift truck mechanism cannot grasp a sufficient portion of the slip sheet to pull it onto the lift truck. The slip sheets improperly grasped are often ripped. This has necessitated, in many situations, totally unloading the sheet to move the goods out of the carrier and then restacking the goods on the sheet for transport by lift truck.

In summary, the prior art has experienced considerable difficulties with both wooden pallets and their paperboard replacements in the past.

SUMMARY OF THE INVENTION

Accordingly, it is an object of the present invention to provide a pallet constructed of paperboard materials which is an effective replacement for wood pallets.

It is another object of the present invention to provide a pallet constructed of paperboard material which has a desirable combination of lateral stability and vertical strength.

It is another object of the present invention to provide an improved pallet constructed of paperboard materials which can be shipped to the point of use disassembled and can then be easily assembled when needed.

It is yet another object of the present invention to provide a pallet constructed of paperboard materials which, after use, can be simply disassembled for storage or shipment in a minimum amount of space.

It is a still further and more specific object of the present invention to provide an alternatively available pallet constructed of paperboard material which is resistant to damage by water or high humidity conditions.

It is yet a further object of the invention to provide a pallet which is of substantially lighter weight with attendant savings in transportation, energy, assembly and freight costs and which presents no difficulties in use.

These and other objects are accomplished according to the present invention which provides a pallet comprising: (a) a first sheet of corrugated paperboard which is cut to define a first set of tabs hinged to said first sheet about fold lines, each tab having a slot therein which extends from a cut end toward the fold line; (b) a second sheet of corrugated paperboard placed in parallel, spaced relation to said first sheet, said second sheet being cut to define a second set of tabs hinged to said second sheet along fold lines perpendicular to the fold lines in said first sheet; each tab in said second set having a slot which extends from a cut end toward the fold line, wherein the slots in the tabs in said first set are aligned and engaged with the slits in opposed tabs in said second set; and (c) a plurality of rigid sleeves, positioned between said first and second sheets and surrounding engaged pairs of opposed tabs.

BRIEF DESCRIPTION OF THE DRAWINGS

The present invention will become better understood and its advantages will become more apparent in view of the following detailed description, especially when read in light of the attached drawings wherein:

FIG. 1 is a perspective view of a pallet according to the invention;

FIG. 2 is a front elevational view of a pallet according to the invention;

FIG. 5 is an enlarged fragmentary left end elevation from FIG. 2 showing a sleeve member partially in section, and showing the corrugations in both upper and lower sheets;

FIG. 6 is a sectional view taken along line 6—6 in FIG. 2;

FIG. 7 is a sectional view taken along line 7—7 in FIG. 2; and

FIG. 8 is a perspective view of a single sleeve member of the type shown in FIGS. 1 and 2.

DETAILED DESCRIPTION OF THE INVENTION

Figure 3:
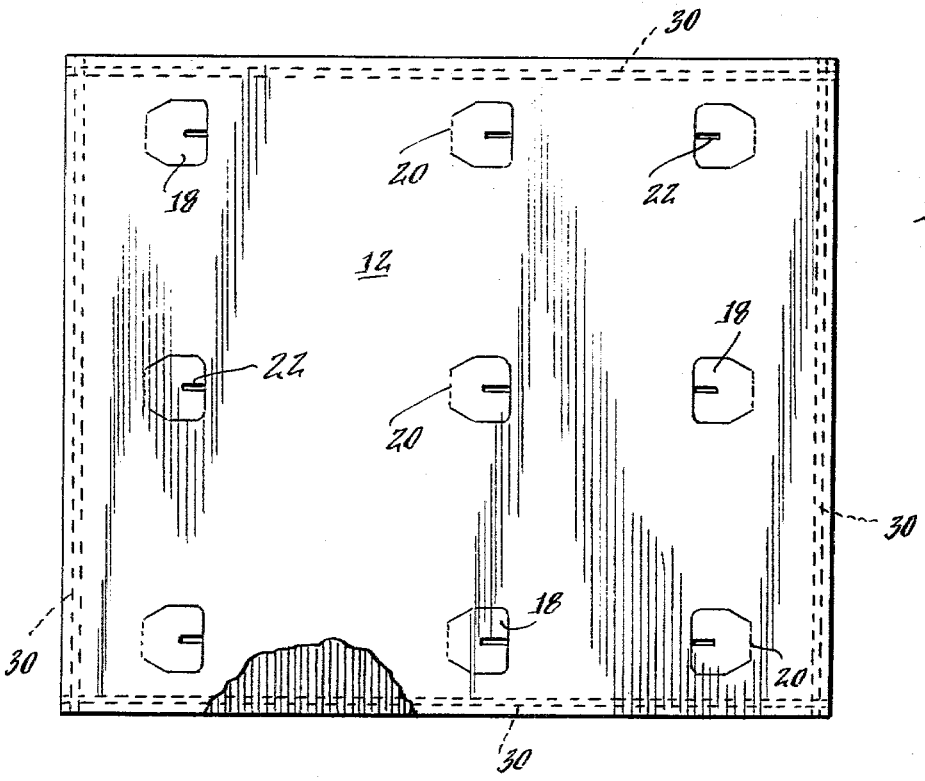
FIG. 3 is a top plan view of a blank for forming a top sheet of a pallet according to the invention.
Figure 4:
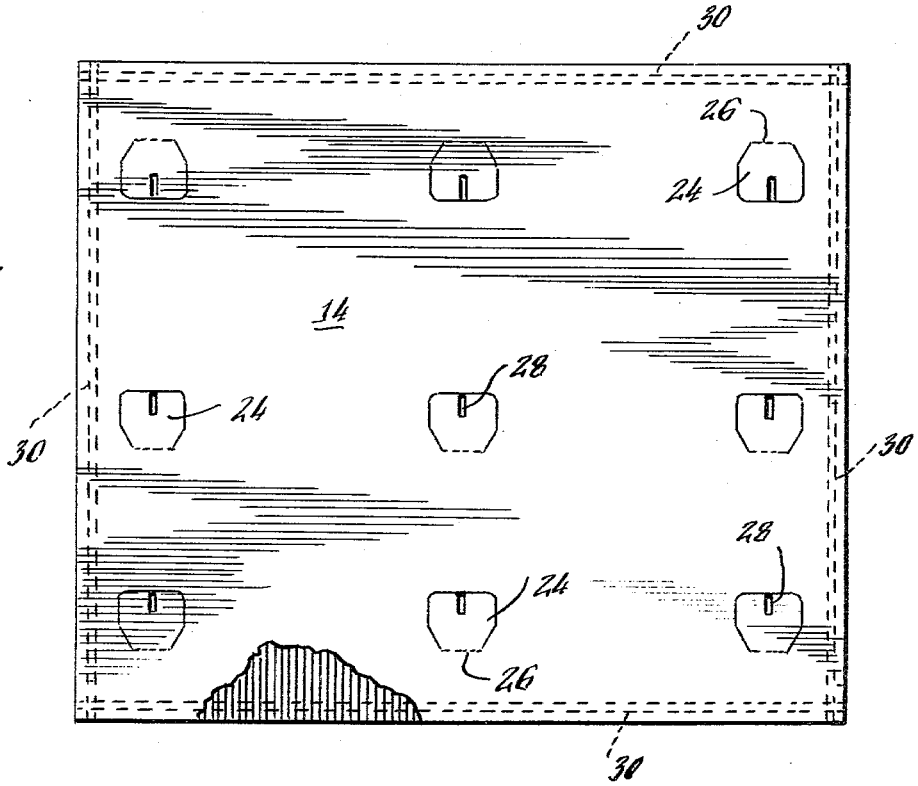
FIG. 4 is a top plan view of a blank for forming a bottom sheet for a pallet according to the present invention.

The present invention provides a pallet which can be wholly constructed of paperboard materials. This pallet is not only stable to lateral forces and able to withstand substantial vertical compression, but maintains these qualities even in the face of wet and humid conditions when treated with appropriate waterproofing materials. A preferred form of pallet according to the invention is identified as 10, shown in perspective in FIG. 1. It will be seen from this figure as well as FIGS. 2 and 5–7, that the pallet has three main portions: a first sheet of corrugated paperboard material 12, a second sheet of corrugated paperboard material 14 and a plurality of sleeves 16 which are positioned between the first and second sheets. The sleeves 16 as shown in FIG. 1 are cylindrical but this shape is not critical and they can just as effectively be of rectangular shape.

The first sheet 12 is shown to be cut at a plurality of positions to define a first set of tabs 18. Each of these tabs is hinged to the first sheet about fold lines 20 and has a sadt 2 at the cut edge oeedsite the mdld line.

The second sheet 14 is also cut at a plurality of positions to define a second set of tabs 24 which likewise are hinged to the second sheet about fold lines 26 and have slots 28 which extend from the cut edge opposite the fold line 26. In the tabs in both the first set and the second set, the slots 22 and 28 will preferably extend from about one-fourth to about one-half the distance from the cut end toward the fold line.

While there is no criticality as to the shape of the first and second sheets, it is most usual and therefore preferable to employ rectangular sheets having flat surfaces of substantially the same size and having a length greater than the width. This, of course, is not essential, and any configuration can be employed.

It is preferable to use corrugated cardboard sheets made of a plurality of plies. Typically, a two-ply corrugated paperboard will be employed. The direction of corrugations can be determined as desired for any particular application, but will most usually be in the widthwise direction. To provide greater structural strength to the assembled pallet, it is possible to have the direction of corrugations in both plies of the first sheet oriented perpendicularly to the direction of the corrugations of both plies of the second sheet. In this arrangement, the hinge lines 20 and 26 can be formed perpendicular to the direction of the corrugations in the plies of the respective sheets 12 and 14.

In one particular embodiment, the top sheet will have the corrugations in both plies extending parallel to the lengthwise dimension, and the hinge lines will all be perpendicular to that dimension. Also, according to this embodiment, the direction of the corrugations in both plies of the bottom sheet will be perpendicular to both plies of the corrugations in the top sheet, and the hinge lines in the bottom sheet will all be parallel to the direction of corrugations in the top sheet. By arranging the directions for the two sheets in this manner, it is possible to obtain a desirable balance of dimensional strengths for a particular end use of the assembled pallet.

Both sheets preferably will be adapted to bend easily at their edges when strapping or other means are employed to hold stacked goods onto the pallet. This can be accomplished as shown in the Figures where creases 30 are formed in the sheet material. Preferably the creases 30 will be formed on the undersides of both of sheets 12 and 14 in spaced pairs or singly along each edge of each of the sheets. Where means, such as these creases 30, for enabling bending of the sheet edge portions are not provided, conventional steel band strapping may more easily cut into and tabs 24 on the second sheet 14. By aligning the slots 22 in the tabs 18 in the first sheet 12 with the slots 28 in the tabs 24 on the second sheet 14 and forcing the two sheets together, the tabs become engaged. Prior to engagement in this manner, however, the sleeves 16 are first positioned over one set of tabs. By forcing the two sheets 12 and 14 together to engage the tabs, the rigid pallet 10 is assembled.

The sleeve 16 is preferably of a spirally-wrapped paperboard material. It can, however, be any suitable material which can be economically produced to offer the adequate strength. For some situations, a corrugated paperboard sleeve will be adequately strong. In the preferred embodiment the inside diameter of the sleeve will be about the same as the height of the sleeve. The height of the sleeve will also be substantially equal to the length of the tab from the fold line to the cut end opposite the fold line of their respective sheets.

To provide suitable strength the tabs will preferably be about as wide as the inside diameter of the sleeves. It is preferred, however, to have the dimension of the fold lines 20 and 26 slightly reduced so that it is smaller than the inside diameter of the cylindrical sleeves 16. It will be seen from the drawings that the outermost tabs in either of the sheets which have their fold lines 20 or 26 parallel to an edge, are preferably positioned such that the tabs associated with them fold outwardly toward that edge.

The detail of the assembly of the tabs 18 from the first sheet 12 with the tabs 24 of the second 14 in combination with the cylindrical sleeves 16 can be seen better from FIGS. 5, 6 and 7. It is seen in these exploded, cross sectional views that the tabs are held in essentially vertical alignment with the sheets by means of the sleeves. The sleeves are dimensioned to frictionally engage the edges of both upwardly extending and downwardly depending tabs to provide a good degree of stability not only to support stacked loads, but also against laterally applied shearing forces and forces which would tend to separate the two sheets. Where nine pairs of engaged tabs, surrounded by sleeves, are employed as shown in FIG. 1, a very strong pallet is obtained.

It is an important feature of the present invention that the paperboard pallet, while lightweight, low in cost, and easily stored, can also be made resistant to wet and humid conditions by providing the first and second sheets with a waterproofing material on at least the surfaces thereof. Preferably, the waterproofing material will comprise a wax which is used to totally impregnate the sheets. The sleeves can also be treated. While not as effective, coatings of wax or other waterproofing materials can also be employed.

The above description has been for the purpose of teaching those skilled in the art how to make and use the present invention and is not meant to detail all of those obvious modifications and variations of it which will become apparent upon reading this disclosure. It is intended, however, to include all such obvious modifications and variations within the scope of the present invention which is defined by the following claims.

What is claimed is:

1. A pallet comprising:

(a) a first sheet of corrugated paperboard which is cut to define a first set of tabs hinged to said first sheet about fold lines, each tab having a slot which extends from a cut end toward the fold line;

(b) a second sheet of corrugated paperboard placed in parallel, spaced relation to said first sheet, said second sheet being cut to define a second set of tabs hinged to said second sheet along fold lines perpendicular to the fold lines in said first sheet, each tab in said second set having a slot which extends from a cut end toward the fold line, wherein the slots in the tabs in said first set are aligned and engaged with the slots in opposed tabs in said second set; and (c) a plurality of rigid sleeves, positioned between said first and second sheets and surrounding engaged pairs of opposed tabs, with the opposed ends of said sleeves functioning as load bearing surfaces, and wherein the width of each said first and second set of tabs adjacent its respective fold line is less than the width of the tab adjacent the cut ends thereof, such that more than one half of each said load bearing ends of said rigid sleeve is disposed contiguous with a sheet whereby the bearing capacity of said pallet is increased.

2. A pallet according to claim 1 wherein the first and second sheets have a waterproofing material on at least the surfaces thereof.

3. A pallet according to claim 2 wherein said waterproofing material comprises a wax which totally impregnates said first and second sheets.

4. A pallet according to claim 1 wherein the first and second sheets have means about their outer edges for enabling the outermost edges to bend under pressure.

5. A pallet according to claim 1 wherein each of said slots extends from about one-fourth to about one-half the distance from the cut end toward the fold line.

6. A pallet according to claim 1 wherein said sleeves are cylindrical and have diameters approximately equal to their height.

7. A pallet according to claim 1 wherein the inside diameter of said sleeves approximately equals the width of said tabs adjacent the cut ends thereof.

8. A pallet according to claim 1 wherein the direction of the corrugations in both sheets is parallel.

9. A pallet according to claim 1 including nine engaged pairs of opposed tabs.

10. A pallet according to claim 9 wherein the first and second sheets have rectangular flat surfaces of equal size, each having a length greater than the width.

11. A pallet according to claim 10 wherein said fold lines in said first sheet are aligned parallel to the lengthwise sides of the sheet, and said fold lines in said second sheet are aligned parallel to the widthwise sides.

12. A pallet according to claim 11 wherein tabs adjacent to the lengthwise sides of said first sheet are cut to bend outwardly about their respective fold lines, and the tabs adjacent the widthwise side in said second sheet are cut to bend outwardly about their respective fold lines.

13. A pallet according to either of claims 1 or 12 wherein said first and second sheets are made of two-ply corrugated board and the direction of corrugations in both plies in said first sheet is perpendicular to the direction of the corrugations in both plies of said second sheet.

14. A pallet according to claim 13 wherein the direction of corrugations in both plies of each sheet is perpendicular to said fold lines therein.

* * * * *

UNITED STATES PATENT AND TRADEMARK OFFICE

CERTIFICATE OF CORRECTION

PATENT NO. : 4,228,744

DATED : October 21, 1980

INVENTOR(S) : Robert L. Moore

It is certified that error appears in the above-identified patent and that said Letters Patent are hereby corrected as shown below:

In Column 3, line 8 delete "sadt 2" and insert in lieu thereof -- slot 22 --;

delete "oeedsite the mdld line" and insert in lieu thereof -- opposite the fold line --.

In Column 3, line 58, after "cut into and" the following was deleted and should be inserted -- damage the pallets. Further, plastic-wrapped pallet loads may become loosened during shipment when suitable means are not provided.

The tabs 18 on the first sheet 12 will be bent about their hinge lines 20 and will be interlocked with the --.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*